United States Patent [19]

Brown

[11] 4,112,727

[45] Sep. 12, 1978

[54] METHOD AND APPARATUS FOR MAKING PIPE FLANGES

[76] Inventor: Marshall B. Brown, P.O. Box 9515, Winter Haven, Fla. 33880

[21] Appl. No.: 783,668

[22] Filed: Apr. 1, 1977

[51] Int. Cl.[2] ..... B21D 7/04; B21D 11/06

[52] U.S. Cl. ..... 72/142

[58] Field of Search ..... 10/73, 74; 29/156.62; 72/135, 142, 143, 144, 149, 156, 157, 158

[56] References Cited

U.S. PATENT DOCUMENTS

| | | | |
|---|---|---|---|
| 390,357 | 10/1888 | Gathmann | 72/142 |
| 393,505 | 11/1888 | Green | 72/142 |
| 1,107,005 | 8/1914 | White | 10/73 |
| 1,156,458 | 10/1915 | Blanchard | 72/142 |
| 2,527,518 | 10/1950 | Benson | 72/142 |
| 2,719,563 | 10/1955 | Nielsen | 72/144 X |
| 3,729,968 | 5/1973 | Norris | 72/142 X |
| 3,807,211 | 4/1974 | Huhnen | 72/142 |
| 3,996,779 | 12/1976 | Hawley | 72/142 |

*Primary Examiner*—E. M. Combs

*Attorney, Agent, or Firm*—Duckworth, Hobby, Allen & Pettis

[57] ABSTRACT

Apparatus for making flanges for large diameter pipe from bar stock of the type having a generally rectangular cross-section includes a substantially flat work surface for supporting the bar stock, a rotatable die position adjacent to the work surface and a drive shaft coupled to a motor for rotation of the die. A bonnet surrounds the die for applying pressure against the bar stock in directions toward the work surface, the bonnet being rotatable with the die and the drive shaft. One end of the bar stock is pinned to the peripheral edge of the bonnet such that the bar stock is bent about one short side thereof and wrapped around the die. The wrapped bar stock, in the form of a helical coil, is severed along a line substantially normal to the long sides thereof to form a plurality of C-shaped members, and the ends of the C-shaped members are joined into an endless loop so as to form the desired flange.

15 Claims, 7 Drawing Figures

34
36
10
24
20
21
22
32
38
45
26
50
14
30
17
28
51
52
12
16
M
18

METHOD AND APPARATUS FOR MAKING PIPE FLANGES

BACKGROUND OF THE INVENTION

1. Field of the Invention

The present invention relates to methods and apparatus for manufacturing flanges for pipe and the like.

2. Description of the Prior Art

There are numerous operations that require the cutting of pipe to length and the joinder of a flange to the ends of the pipes so that the pipe can be joined to an adjacent pipe length. The flanges required for such operations come in many sizes and thicknesses, depending upon the particular application and the restrictions imposed in terms of pressure developed in the pipe and so forth.

One prior art method for manufacturing flanges utilizes common rectangular bar stock which is bent about one short edge thereof in successive bends in a three-roller system. Machines of this type may be either hand operated, or alternatively, may take the form of rather complex machines which serve a similar purpose. See, for example, U.S. Pat. Nos. 2,394,193 to McCabe; and see, 2,498,686 to Johnson, as well as 2,255,867 to Wisckol.

One of the difficulties of prior art flange making machines is that the resulting flange often is not planar because the bending operation results in a "bowing" of the bent bar stock. This results in low yield and high wastage with respect to the raw materials used in the bending process.

Other prior art patents of interest include the following: U.S. Pat. Nos. 3,920,174 to Lanborn; and 2,717,072 to Andrews, et al. In U.S. Pat. No. 2,748,924, McIlvried discloses a draw block mechanism designed for the drawing of metal tubing and the like.

SUMMARY OF THE INVENTION

The present invention contemplates a method for making flanges for large diameter pipe from bar stock of the type having a generally rectangular cross-section, the method comprising the steps of pinning one end of the bar stock to a point adjacent to a die, with one short side of the stock abutting the die. Pressure is applied against the long sides of the bar stock, while the die is simultaneously rotated with the pinning point to bend the bar stock about the die, to thereby form a coil of the bar stock. The coil of stock is thereafter severed along a line substantially normal to the long sides thereof to form a plurality of C-shaped members. The ends of the C-shaped members are joined together in an endless loop, and spaced holes are formed in the endless loop between the long sides thereof to complete the flange.

Apparatus in accordance with the present invention contemplates a substantially flat work surface for supporting the bar stock with the long sides thereof parallel with the plane of the work surface. A rotatable die is positioned adjacent to the work surface. Means are also provided for pinning one end of the bar stock in a position substantially parallel with the work surface, with means for applying pressure against the bar stock in directions toward the work surface. Further means are provided for rotating the pinning means with the die whereby the bar stock is bent about one short side thereof and wrapped around the die.

In accordance with the preferred embodiment of the present invention, the pressure applying means comprises a hollow bonnet surrounding the die and having a peripheral edge engaging the bar stock with means, such as a hydraulic cylinder, coupled to the bonnet for applying a force against the bonnet in directions generally parallel with the axis of the die.

Further in accordance with the present invention, both the die and the bonnet are provided with communicating keyways with a key extending through both and coupling the bonnet and the die for rotation together with the driveshaft, whereby the die is readily exchanged for another die by removal of the key and the bonnet.

THE DRAWING

DETAILED DESCRIPTION

A preferred embodiment of the flange making apparatus in accordance with the present invention will now be described with reference to FIGS. 1, 2 and 3.

The flange making machine, referred to generally as 10, includes a work table 12 having a flat upper work surface 14 for supporting bar stock 50 during the flange making process.

Figure 1:
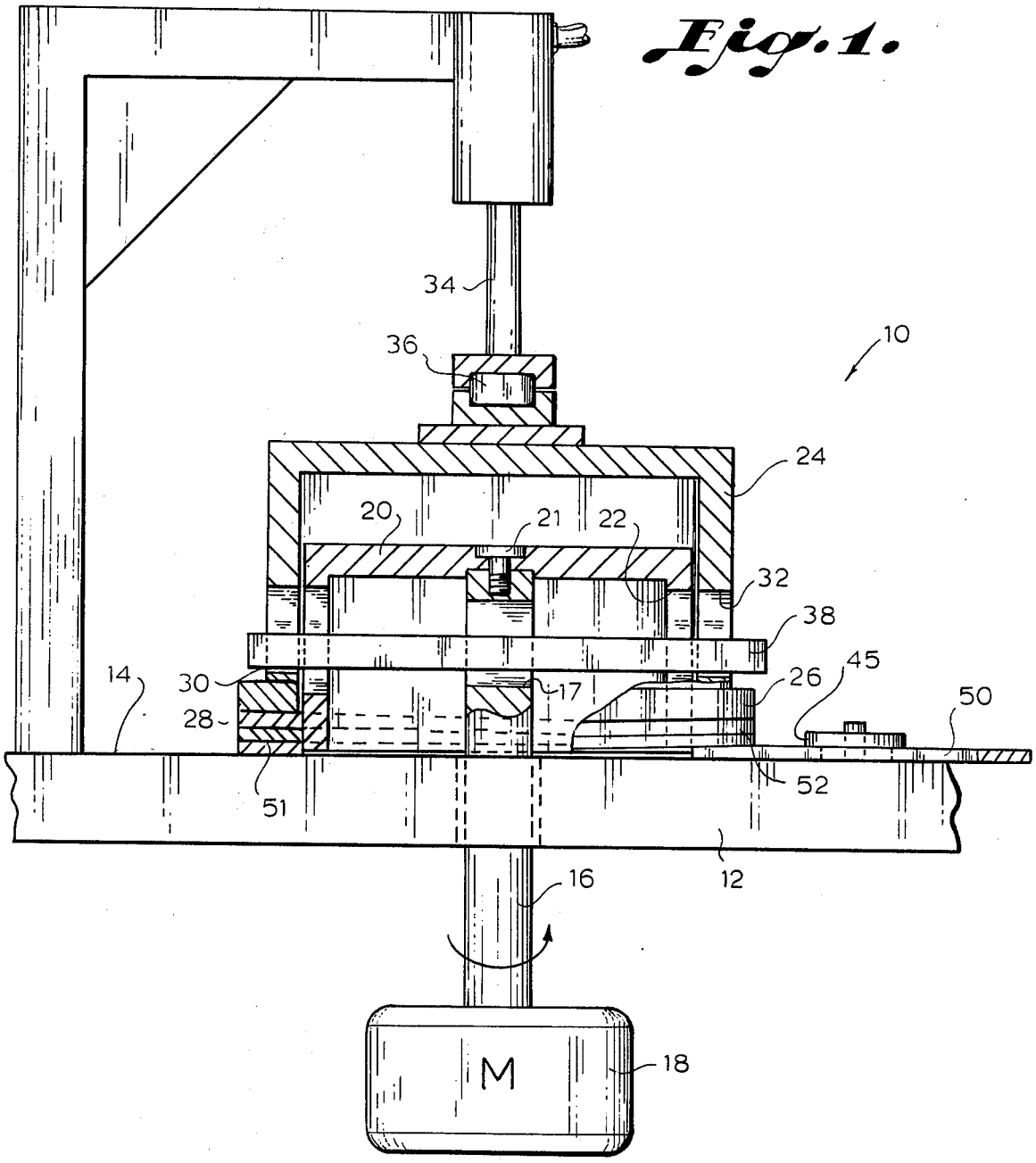
FIG. 1 is front elevation, partially cut away, illustrating one embodiment of a flange making machine in accordance with the present invention.
Figure 2:
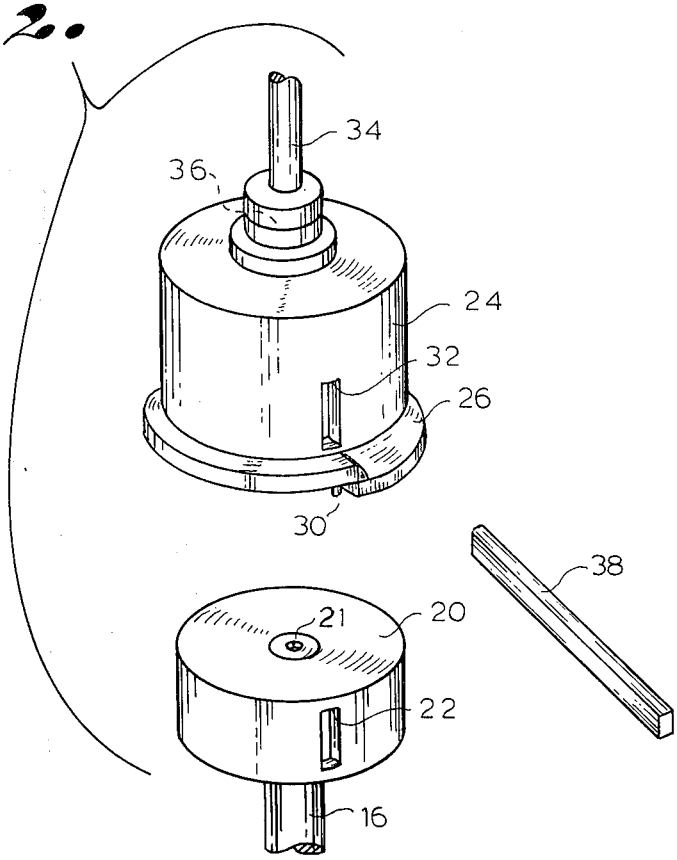
FIG. 2 is a side elevation of the apparatus of FIG. 1.

A drive shaft 16 extends through an appropriate aperture (not shown) in the table 12 and the work surface 14 and is driven by a conventional motor 18, shown by block diagram in FIG. 1. The drive shaft 16 includes a keyway 17 therein.

The machine 10 further includes a rotatable die 20 in the form of a hollow cylinder, having an appropriate opening therein to receive the drave shaft 16, the die 20 being inverted over the end of the drive shaft such as to provide a clearance between the extremity of the die and the work surface 14 to allow free rotation of the die. A bolt 21 extends through the die and fastens the die to the shaft 16. The die 20 further includes a keyway 22 corresponding to the keyway 17 in the drive shaft 16, and having a dimension in a direction normal to the work surface 14 which is described in greater detail below.

The machine 10 is further provided with a bonnet 24 in the form of a cup shaped hollow cylinder inverted over the die 20. The bonnet 24 includes a discontinuous flange 26 at the extremity thereof, the flange having a raised end 28 and a pin 30 extending from the lower surface toward the work surface 14. While the width of the flange 26 is not critical, preferably the flange is of a sufficient lateral dimension so as to allow the flange to engage the upper long side of the bar stock 50 which is to be wrapped about the die 20 to form a helical coil of flange material, in the manner described in greater detail below. The bonnet 24 also includes a keyway 32 having dimensions like the keyways 22 and 17 of the die 20 and the drive shaft 16, respectively. A key 38 extends through the respective keyways 32, 22 and 17 to engage the die 20 and the bonnet 24 with the drive shaft 16 for rotation therewith.

The machine 10 is further provided with a hydraulic cylinder having an extensible shaft 34 positioned over the bonnet 24 such that movement of the shaft 34, upon operation of the hydraulic cylinder, is in directions substantially axial with the die 20 and the bonnet 24. A thrust bearing 36 is positioned between the extremity of the shaft 34 and the bonnet 24, allowing rotation of the bonnet with the die 20 and the drive shaft 16.

Figure 3:
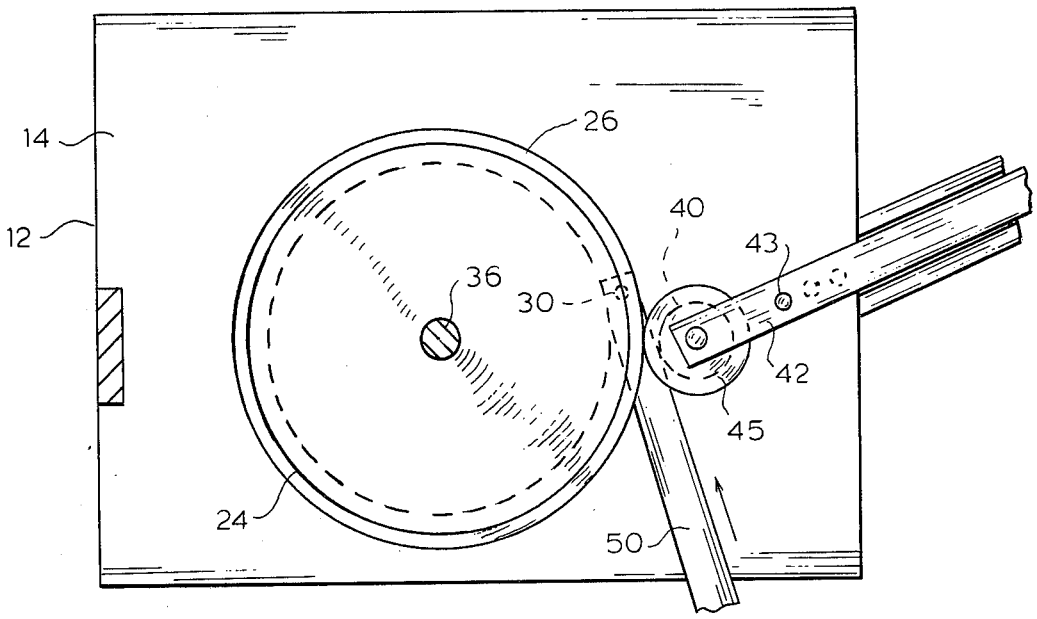
FIG. 3 is a top view of the apparatus of FIG. 1.

With specific reference to FIGS. 1 and 3, a guide roller 40 is mounted on an adjusting arm 42 which is adjustable with respect to the periphery of the bonnet by means of a bolt 43 so as to allow dimensional variations for the guide roller 40, for different size die and bonnet combinations. A slide tray 41 is joined to the side of the work table 12, and serves to guide the adjusting arm 42. The guide roller 40 includes a flange 45 which extends over the bar stock 50.

Operation of the machine 10 will now be described with reference to FIGS. 1, 2 and 3.

Noting FIG. 1, bar stock 50 to be bent is provided with a hole 51 at one end thereof. The bar stock 50 is then positioned across the work surface 14 against the guide roller 40 and under the flange 45, with the hole 51 engaging the pin 30 extending from the raised end 28 of the flange 26. The hydraulic cylinder above the bonnet 24 is then operated, extending the shaft 34 downward such that the flange 26 of the bonnet makes appropriate contact with the bar stock 50 across the upper long side thereof. The key 38 is then inserted through the keyways 32, 22 and 17, to lock the drive shaft 16, the die 20 and the bonnet 24 together. Pressure from the hydraulic cylinder is then increased along the shaft 34, causing an increase in pressure across the upper long side of the bar stock 50 positioned underneath the flange 26 of the bonnet 24.

Figure 4:
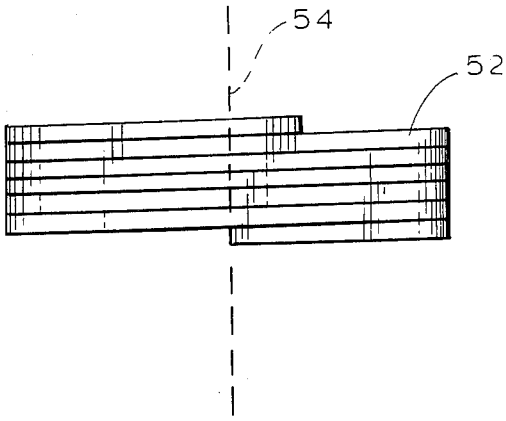
FIG. 4 is a side view of a coil of flanges made in accordance with the method of the present invention.

At this point, the motor 18 is energized, causing the drive shaft 16 to rotate in a counter-clockwise direction (in the specific example shown in FIG. 1). As a result, the bar stock 50 is wrapped about the periphery of the die 20, forming a helix 52 of the bar stock material. This operation continues until such time as the pressure from the increasing amounts of bar stock 50 in the helix 52 raises the key 38 near the upper extremity of the keyways 32, 22 and 17. At that point, operation of the motor 18 is terminated and pressure on the hydraulic cylinder is reversed, causing the shaft 34 to move the bonnet 24 in an upward direction. As soon as the bonnet 24 is well clear of the die 20, the helix 52 may be removed from about the sides of the drum 20; or alternatively, the drum 20 may be picked up so as to leave the helix 52 lying on the work surface 14. The bar stock 50 is then cut adjacent to the beginning of the curved portion near the periphery of the die 20, leaving the form of a helix 52 as is shown in FIG. 4. The helix 52 is then severed along a line 54 which is substantially normal to the long sides of the bar stock 50 forming the helix 52. This severing operation may be undertaken by the use of a friction saw, or similar conventional apparatus.

Figure 5:
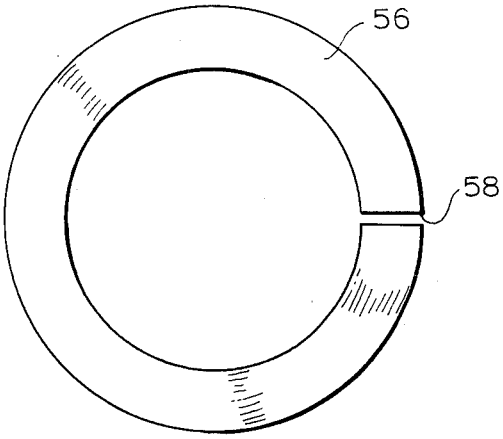
FIGS. 5 and 6 illustrates further steps in the method of the present invention.
Figure 6:
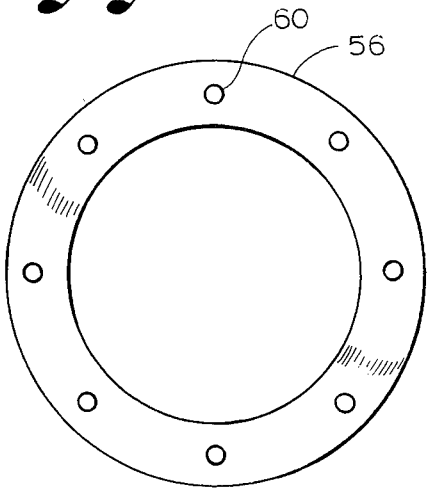

As a result of the severing operation just referred to above, the helix is cut into a plurality of C-shaped members 56, as shown in FIG. 5, each member having a slot 58 between the ends thereof caused by the severing along the line 54 (FIG. 4). In order to complete the flange making operation, the slot 58 is welded to create a continuous loop of material; appropriate buffing and sanding is undertaken and the member 56 is placed in a punch machine or similar apparatus to punch spaced holes 60 about the member 56 for bolt holes.

It will be appreciated by those skilled in the art that the apparatus pin provides a facile means for manufacturing flanges of various sizes and in which the resulting flange is substantially planar. Different sizes of the flanges may be obtained by simply changing the die 20 and bonnet 24 combination after removal of the key 38 and the bonnet 24. Of course, bar stocks of different widths and thicknesses may be employed in conjunction with the machine 10, to obtain flanges of different sizes.

As noted above, the long dimension of the keyways 32, 22 and 17 determines the amount of bar stock 50 which may be wrapped around the die 20 in any one helix-forming operation. This arrangement allows a number of flanges of a like dimension to be formed at the same time.

Figure 7:
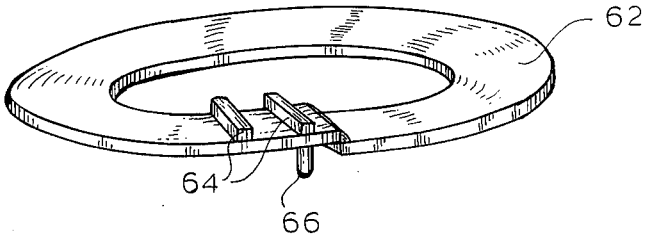
FIG. 7 is a side view of an adapter for the apparatus of FIG. 1.

An adapter insert for use of relatively thin bar stock is shown in FIG. 7. The insert comprises a flange 62 having a shape corresponding to the flange 26 attached to the bonnet 24 with one end thereof discontinuous and having a pin corresponding to the pin 30. The flange 62 further includes lateral bars 64 welded thereon for engagement by the pin 30 (FIG. 2).

Numerous modifications may be made to the apparatus disclosed above without departing from the spirit and scope of the invention. For example, to reduce friction between the work surface 14 and the stock 50 during bending, it is feasible to rotate the work surface and the die together, with the guide roller 40 maintaining a fixed position.

Further, it is also feasible to avoid rotation of the bonnet 24 by pinning the one end of the bar stock 50 to the die for rotation therewith. To avoid friction losses for a non-rotating bonnet peripheral bearings could be attached.

The lateral key 38 may be replaced with a conventional tray extending vertically from the drive shaft 16.

Additionally, it is not absolutely necessary that the rotatable die constitute a cylinder but could have an oval cross-section or the like for flanges having special purposes. It will, of course, be understood that a corresponding bonnet need also be provided with each change of the die.

I claim:

1. Apparatus for making flanges from bar stock of the type having a generally rectangular cross-section, comprising:

a substantially flat work surface for suporting said bar stock with the long sides of said stock parallel with the plane of said work surface;

a rotatable die positioned adjacent to said work surface;

means for rotating said die;

means for pinning one end of said bar stock in a position substantially parallel with said work surface;

a hollow bonnet surrounding said die and having a peripheral edge engaging said bar stock;

means for applying a force against said bonnet in directions generally parallel with the axis of said die;

means for rotating said pinning means with said die for bending said bar stock about one short side thereof and wrapping said bar stock about said die; and means for rotating said bonnet with said die.

2. Apparatus recited in claim 1 wherein said bonnet includes a flange at said peripheral edge, said pinning means including means for pinning at one end of said bar stock to said bonnet flange.

3. The apparatus recited in claim 2 wherein said means for rotating said bonnet with said die comprises:
a keyway extending through said die and said bonnet; and
a key extending through said keyway to couple said bonnet and said die for rotation together.

4. The apparatus recited in claim 3 wherein said rotating means comprises a drive shaft extending substantially axial with said drive.

5. The apparatus recited in claim 4 further comprising said keyway extending through said drive shaft, with said key also extending through said drive shaft to couple said bonnet and said die to said drive shaft for rotation therewith, whereby said die is readily exchanged for another due by removal of said key and said bonnet.

6. The apparatus recited in claim 5 wherein said keyway comprises each of said die, said bonnet and said drive shaft having a corresponding elongated slot having a dimension in a direction away from said work surface which is substantially greater than the corresponding dimension of said key, whereby said key is allowed to move away from said work surface as increased amounts of bar stock are wrapped around said die between said work surface and the peripheral edge of said bonnet.

7. The apparatus as recited in claim 2 further comprising:
a roller mounted on said work surface and spaced from said die for guiding said bar stock across said work surface; and
means for adjusting the position of said roller with respect to said bonnet.

8. The apparatus recited in claim 2 wherein said die and said bonnet each comprise a hollow cylinder, the inner diameter of said bonnet being greater than the outer diameter of the die.

9. Apparatus for making flanges from bar stock comprising:
a cylindrical die;
means for rotating said die;
a hollow, cylindrical bonnet surrounding said die and having a peripheral edge adapted to engage said bar stock;
means for applying pressure against said bonnet in a direction toward said bar stock;
means for supporting said bar stock against pressure from said bonnet;
means for rotating said die and said bonnet together; and
means for pinning one end of said bar stock to one of said die and said bonnet so as to rotate said one end of said bar stock therewith to wrap said bar stock about the periphery of said die.

10. The apparatus recited in claim 9 wherein said means for applying pressure against said bonnet comprises:
a hydraulic cylinder having an extensible shaft substantially axial with said bonnet and said die; and
a thrust bearing between the extremity of said extensible shaft and said bonnet.

11. The apparatus recited in claim 9 wherein said pinning means comprises:
a flange surrounding said peripheral edge of said bonnet, said flange being discontinuous about said peripheral edge, with one end thereof being further from said supporting means than the other end; and
a pin extending through one end of said flange and adapted to engage a corresponding hole in said one end of said bar stock.

12. The apparatus recited in claim 11 further comprising an adapter ring for insertion between said flange and said supporting means, said adapter ring being shaped to conform to said flange and including a pin.

13. Apparatus for making flanges for pipe from bar stock of the type having a generally rectangular cross section comprising:
a flat work surface for supporting said bar stock;
a rotatable die;
means for rotating said die;
a hollow bonnet surrounding said die and having a peripheral edge with a flange thereon adapted to engage one long side of said bar stock;
means for applying pressure against said bonnet in a direction toward said bar stock;
means for pinning one end of said bar stock to said flange of said bonnet;
a drive shaft extending axial with said die;
means for rotating said drive shaft;
a slotted keyway extending through each of said bonnet and said die; and
a key extending through said keyway for rotation of said die and said bonnet with said shaft, for readily exchanging said die and bonnet combination for another die and bonnet by removing said key and said bonnet.

14. The apparatus recited in claim 13 wherein each slotted keyway in said bonnet and said die comprise an elongated slot having a dimension in a direction away from said work surface which is substantially greater than the corresponding dimension of said key, whereby said key is allowed to move away from said work surface as increased amounts of bar stock are wrapped around said die between said work surface and the extremity of said bonnet.

15. In combination:
a work table having a substantially flat work surface;
a drive shaft extending through said work surface;
means for rotating said drive shaft;
a cylindrical die rotatably mounted on said drive shaft;
a hollow, cylindrical bonnet concentrically mounted about said die;
means for moving said bonnet toward and away from said work surface, for pressurizing objects adjacent to the periphery of said die between the peripheral edge of said bonnet and said work surface; and
means for rotating said die and said bonnet with said drive shaft for wrapping and bending said objects about the peripheral surface of said die.

* * * * *